US008414392B2

(12) United States Patent
Hsu

(10) Patent No.: US 8,414,392 B2
(45) Date of Patent: Apr. 9, 2013

(54) METHOD FOR PREVENTING REPEATING IDENTIFICATION OF CARD IMAGES

(76) Inventor: Tien-Shu Hsu, Taichiu (TW)

( * ) Notice: Subject to any disclaimer, the term of this patent is extended or adjusted under 35 U.S.C. 154(b) by 413 days.

(21) Appl. No.: 12/771,342

(22) Filed: Apr. 30, 2010

(65) Prior Publication Data

US 2011/0269539 A1 Nov. 3, 2011

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl.
USPC ..... 463/30; 463/13; 463/29; 463/22; 209/584; 209/587; 273/149; 273/292

(58) Field of Classification Search ..... 209/587, 209/584; 463/13, 29, 30, 22; 273/149, 292
See application file for complete search history.

(56) References Cited

U.S. PATENT DOCUMENTS

| | | | | |
|---|---|---|---|---|
| 6,403,908 | B2 * | 6/2002 | Stardust et al. | 209/587 |
| 2004/0043808 | A1 * | 3/2004 | Niekawa et al. | 463/13 |
| 2005/0026681 | A1 * | 2/2005 | Grauzer et al. | 463/29 |

* cited by examiner

*Primary Examiner* — Omkar Deodhar
*Assistant Examiner* — Adetokunbo O Torimiro
(74) *Attorney, Agent, or Firm* — Muncy, Geissler, Olds & Lowe, PLLC

(57) ABSTRACT

A method for preventing repeating identification of card symbols. The method includes obtaining an environmental image of an identification zone as a reference sample before the game starts; a dealer dealing a poker card into the identification zone with the card image identified and continuously obtaining the current image of the identification zone; after the poker card is moved to a card display zone, comparing the current image with the reference sample. If the difference between the current image and the reference sample is smaller than an error allowance value, judging the poker card is fully removed from the identification zone, and proceeding dealing and identification process of next round. If the difference between the current image and the reference sample is greater than an error allowance value, judging the poker card is not fully removed from the identification zone, then the dealer can perform manual process as required.

4 Claims, 8 Drawing Sheets

METHOD FOR PREVENTING REPEATING IDENTIFICATION OF CARD IMAGES

FIELD OF THE INVENTION

The present invention relates to a poker game system and particularly to a poker game system that can prevent repeating identification of card images.

BACKGROUND OF THE INVENTION

Please refer to FIGS. 1A, 1B and 1C, a conventional poker game starts by a dealer taking a poker card 2 out from a card box 1 (as shown in FIG. 1A); the poker card 2 passes through a identification zone 3 (as shown in FIG. 1B), then is placed on a card display zone 4 (as shown in FIG. 1C). There is a video identification system 6 located beneath a table 5. When the poker card 2 passes through the identification zone 3, its image can be obtained and a card image can be received after the image is digitizedly processed.

Referring to FIG. 2, in the aforesaid card dealing process, while the poker card 2 passes through the identification zone 3, the video identification system 6 captures the image continuously. The poker card 2 could be identified twice, especially if the dealer moves the poker card 2 hesitantly, mistakenly or shakes the poker card 2 intentionally for cheating purpose. By moving the poker card 2 back and forth at the border of the identification zone 3, the video identification system 6 could mistakenly identify the same card twice, and the card image identified by the video identification system 6 could be different from the actual one on the table 5. As a result, the dealer has to modify manually. It is not only troublesome and consumes a lot of time, utilization time of the table 5 suffers, and the casino owner could distrust the dealer.

SUMMARY OF THE INVENTION

Therefore, the primary object of the present invention is to provide a method for preventing repeating identification of card images.

To achieve the foregoing object, the method according to the invention comprises a video identification system and a table having an identification zone to identify the card image of at least one poker card. The method comprises steps as follow: the video identification system obtains an environmental image of the actual site of the identification zone as a reference sample; a dealer deals an unidentified poker card in the identification zone with the card image of the poker card identified by the video identification system; the video identification system continuously obtains a current image of the identification zone; after the poker card is fully removed from the identification zone, the current image is identical with the reference sample, and the poker card is judged as fully removed from the identification zone.

Therefore, through the video identification system of the invention, only after the poker card has been judged fully removed from the identification zone, the identification of next round proceeds, i.e. before the poker card is being fully removed from the identification zone, even if the video identification system identifies and obtains two or more card images, they can be treated as the same card image, thus repeating identification of the card image can be prevented to meet actual requirements.

The foregoing, as well as additional objects, features and advantages of the invention will be more readily apparent from the following detailed description, which proceeds with reference to the accompanying embodiment and drawings. The embodiment serves only for illustrative purpose and is not the limitation of the invention.

DETAILED DESCRIPTION OF THE PREFERRED EMBODIMENT

Figure 1A:
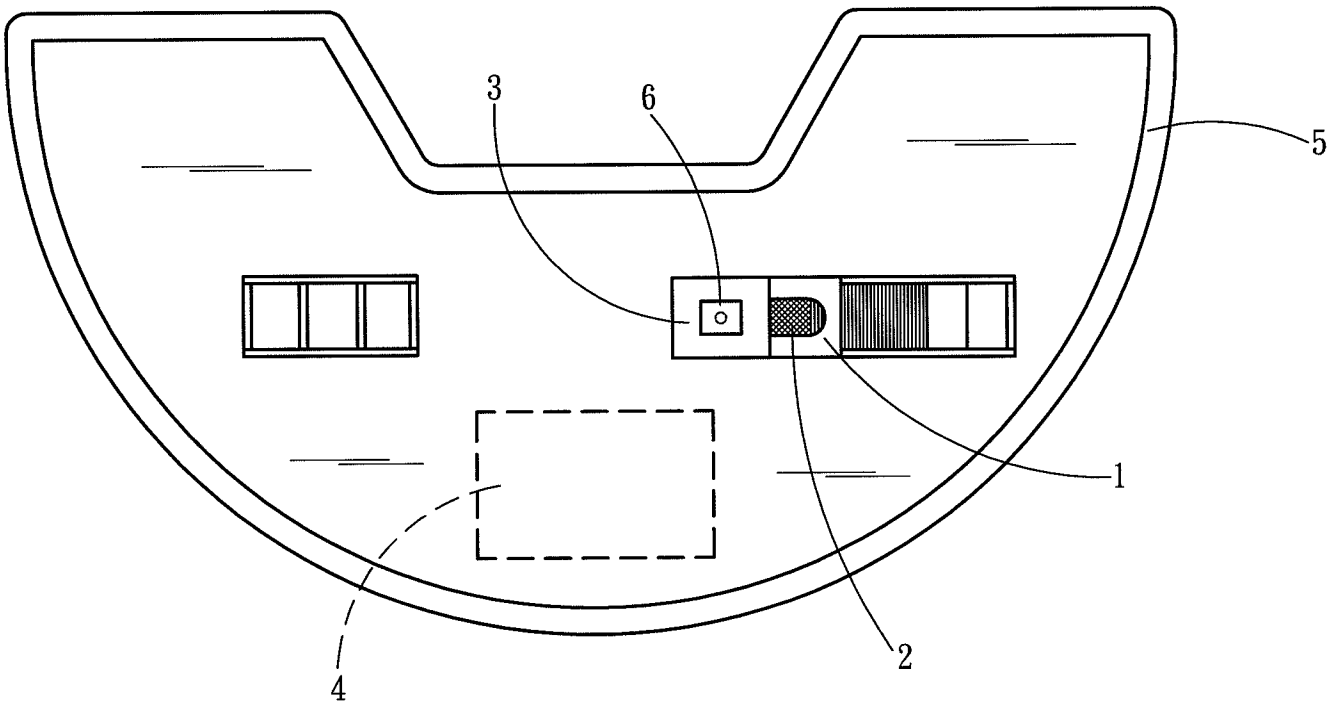
Fig. 1A PRIOR ART
FIG. 1A is a schematic view of conventional card dealing process-1 by a dealer.
Figure 1B:
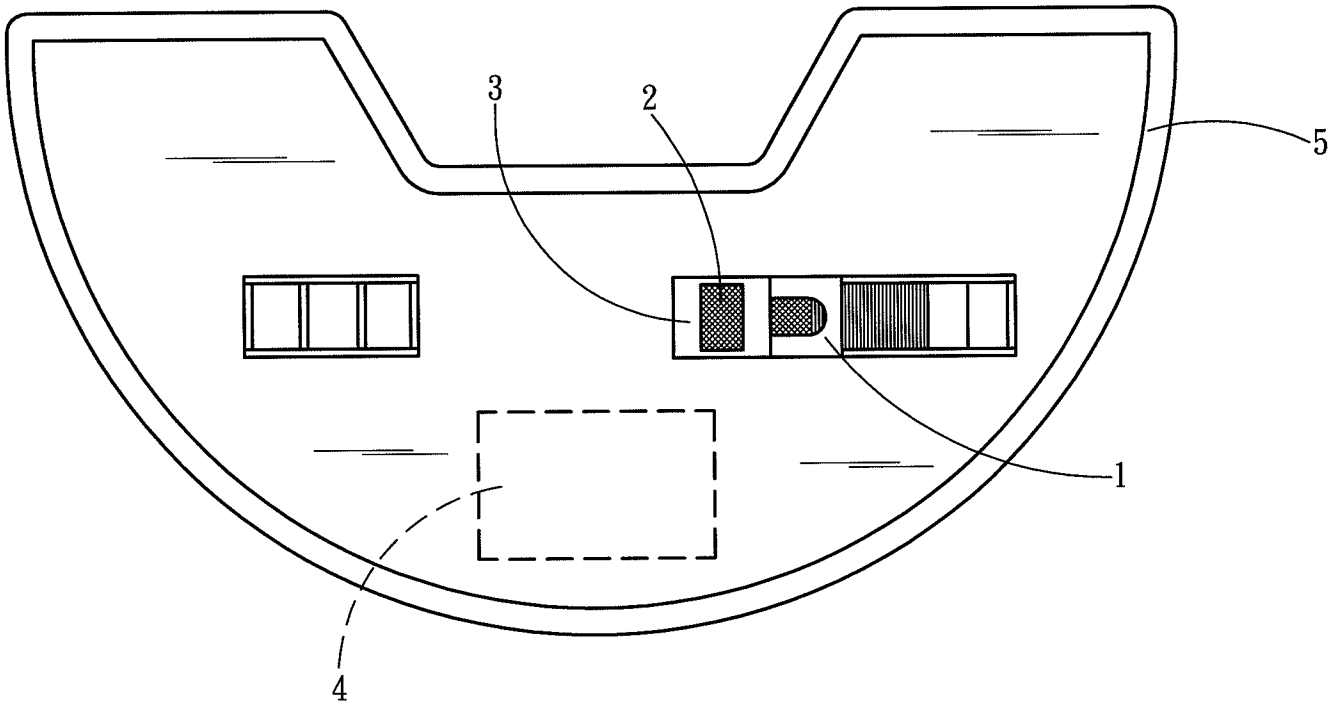
Fig. 1B PRIOR ART
FIG. 1B is a schematic view of conventional card dealing process-2 by a dealer.
Figure 1C:
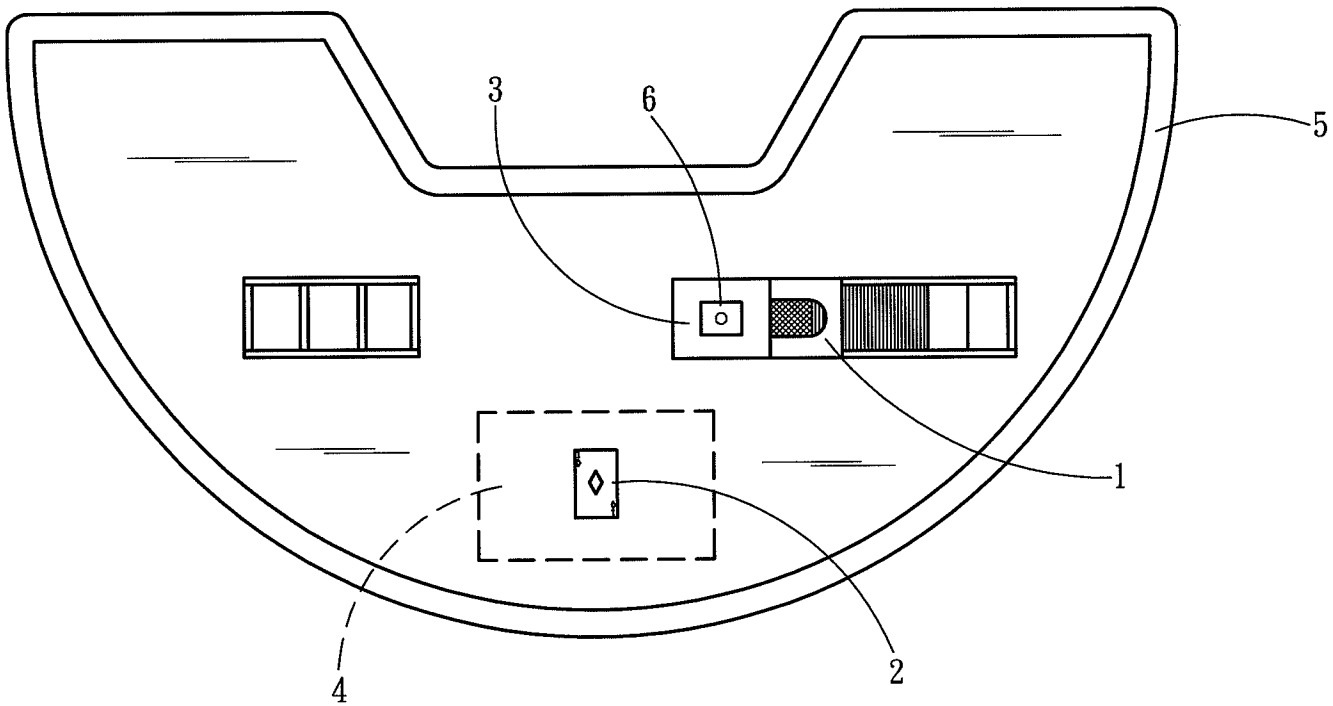
Fig. 1C PRIOR ART
FIG. 1C is a schematic view of conventional card dealing process-3 by a dealer.
Figure 2:
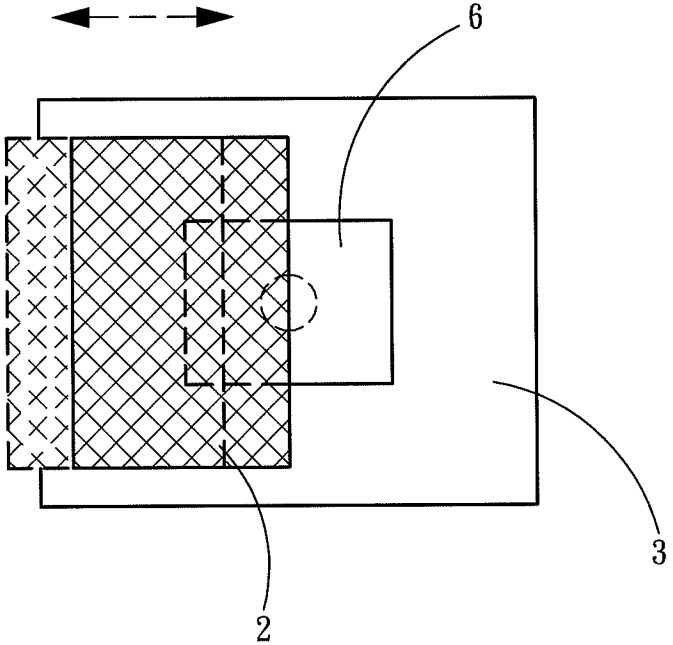
Fig. 2 PRIOR ART
FIG. 2 is a schematic view of conventional repeating identification of card image.
Figure 3A:
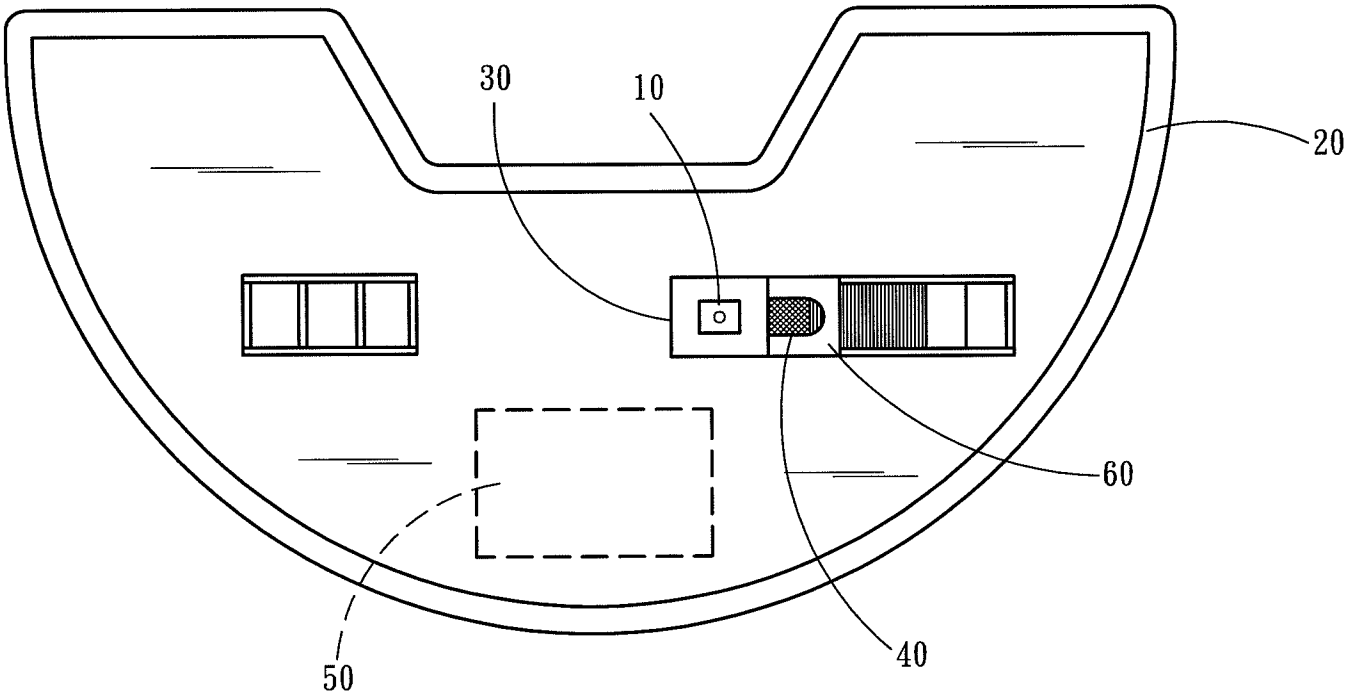
FIG. 3A is a schematic view of card dealing process-1 by a dealer according to the invention.
Figure 3B:
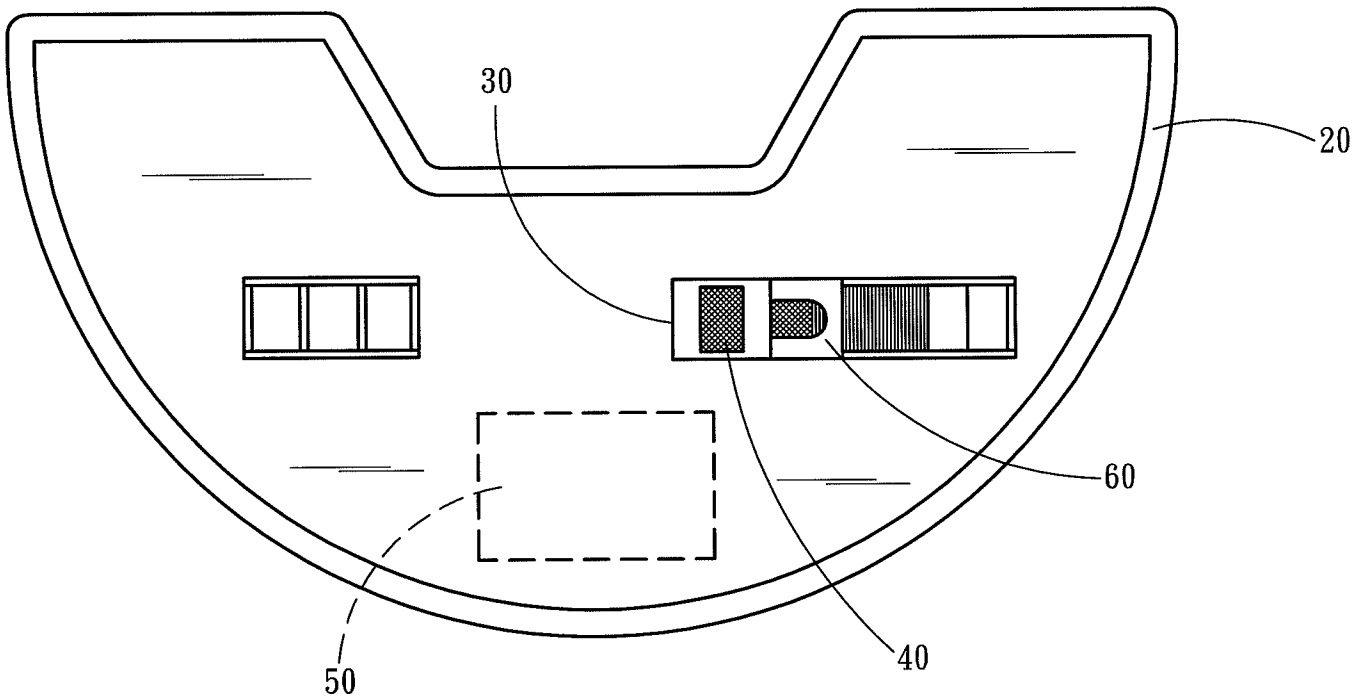
FIG. 3B is a schematic view of card dealing process-2 by a dealer according to the invention
Figure 3C:
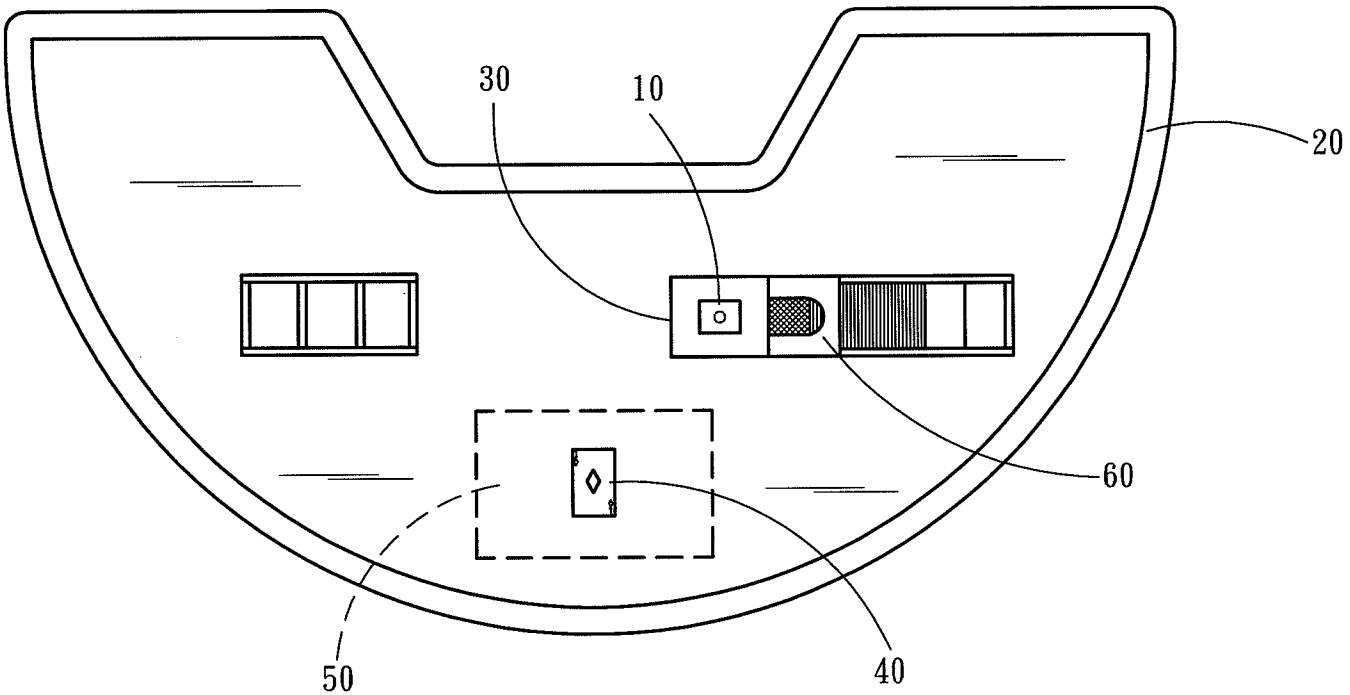
FIG. 3C is a schematic view of card dealing process-3 by a dealer according to the invention.
Figure 4:
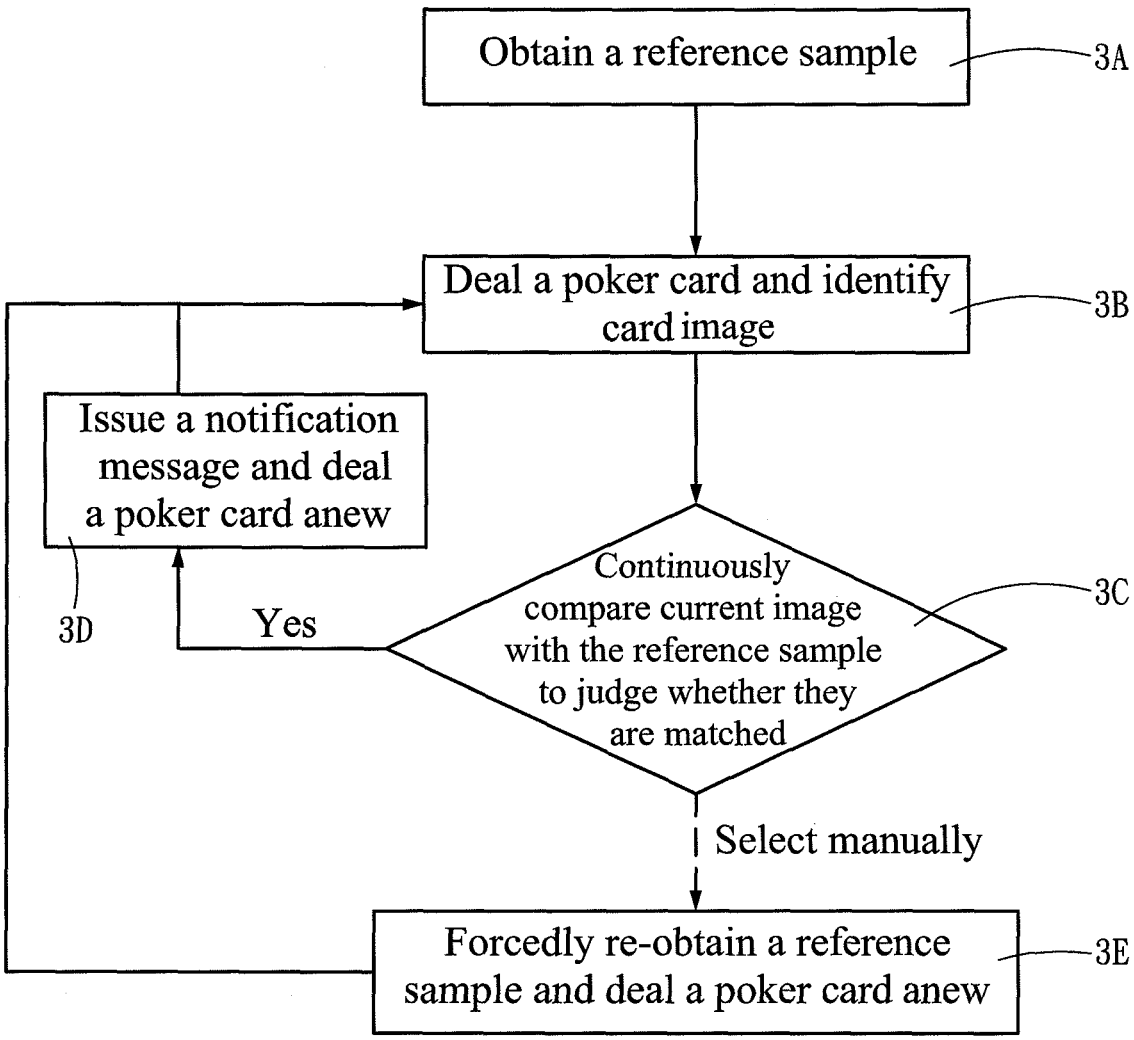
FIG. 4 is a flowchart of dealing card by a dealer according to the invention.

Please refer to FIGS. 3A through 4, the method for preventing repeating identification of card images according to the invention comprises a video identification system 10 to identify the card image of at least one poker card 40 placed in an identification zone 30 of a table 20. The identification zone 30 is a transparent board. The video identification system 10 faces the identification zone 30. At least one poker card 40 is held in a card box 60. The method comprises the steps as follow:

First, step 3A: referring to FIG. 3A, the video identification system 10 obtains an environmental image of the actual site of the identification zone 30 to serve as a reference sample;

Next, step 3B: referring to FIG. 3B, a dealer deals a unidentified poker card 40 from the card box 60 into the identification zone 30 to allow the video identification system 10 to identify the card image of the poker card 40;

Next, step 3C: the video identification system 10 continuously obtains the current image of the actual site of the identification zone 30, and compares the current image with the reference sample to judge whether the images match each other; while judging whether the images are identical, if the difference between the current image and the reference sample is smaller than an error allowance value, they are judged the same. On the other hand, if the difference between the current image and the reference sample is greater than the error allowance value, they are judged different.

Next, step 3D: the identified poker card 40 is fully removed from the identification zone 30 to a card display zone 50 on the table 20 (as shown in FIG. 3C); in the event that the current image matches the reference sample, and the poker card 40 is judged fully removed from the identification zone 30, and the video identification system 10 issues a notification message to inform the dealer that the poker card 40 has been fully removed form the identification zone 30, and other unidentified poker card 40 may be dealt into the identification zone 30 to be identified by the video identification system 10.

Step 3E: In the event that external environment light alters and the identified poker card 40 is moved to the card display zone 50 on the table 20, the current image is different from the reference sample, and the dealer or a supervisor can select to proceed step 3E manually to forcedly re-obtain a new environmental image as the reference sample, then enter to the next step.

By means of the process set forth above, the continuous current image can be obtained and compared with the reference sample to make sure that the poker card 40 is fully removed from the identification zone 30. Before the poker card 40 is fully removed from the identification zone 30, the video identification system 10 cannot identify any card symbol correctly, and also cannot deem the poker card 40 has been removed from the identification zone, thus no repeating identification of the card image occurs.

What is claimed is:

1. A method for preventing repeating identification of card images to identify a card image of at least one poker card which has passed through an identification zone on a table through a video identification system that faces the identification zone, comprising the steps of:

obtaining an environmental image of the actual site of the identification zone through the video identification system before an unidentified poker card enters the identification zone and serving the environmental image as a reference sample;

dealing the unidentified poker card into the identification zone and identifying the card image of the poker card through the video identification system in the identification zone; and obtaining continuously current images of the identification zone through the video identification system, comparing the current images of the identification zone with the reference sample, and judging that the poker card has been fully removed from the identification zone when one of the current images of the identification zone matches the reference sample.

2. The method of claim 1, wherein the video identification system issues a notification message when the poker card is judged fully removed from the identification zone.

3. The method of claim 1, wherein after judging the poker card is fully removed from the identification zone, an unidentified poker card is dealt to the identification zone to identify the card image of the poker card in the identified zone through the video identification system.

4. The method of claim 1, wherein forcedly re-obtaining an environmental image to be the reference sample when the current image is different from the reference sample after the poker card is removed from the identification zone due to environment changes.

* * * * *